US009868305B2

(12) United States Patent
Yamamoto et al.

(10) Patent No.: US 9,868,305 B2
(45) Date of Patent: Jan. 16, 2018

(54) INKJET PRINTING APPARATUS

(71) Applicant: SCREEN Holdings Co., Ltd., Kyoto (JP)

(72) Inventors: Takaharu Yamamoto, Kyoto (JP); Shinsuke Yamashita, Kyoto (JP); Osamu Morizono, Kyoto (JP)

(73) Assignee: SCREEN Holdings Co., Ltd. (JP)

( * ) Notice: Subject to any disclaimer, the term of this patent is extended or adjusted under 35 U.S.C. 154(b) by 0 days.

(21) Appl. No.: 14/788,965

(22) Filed: Jul. 1, 2015

(65) Prior Publication Data

US 2016/0052305 A1 Feb. 25, 2016

(30) Foreign Application Priority Data

Aug. 19, 2014 (JP) ..... 2014-166764

(51) Int. Cl.
*B41J 15/04* (2006.01)

(52) U.S. Cl.
CPC ..... *B41J 15/04* (2013.01)

(58) Field of Classification Search
USPC ..... 347/102, 103, 104
See application file for complete search history.

(56) References Cited

U.S. PATENT DOCUMENTS 3,825,724 A * 7/1974 Kingsley ..... G03G 15/2014 219/216
4,952,281 A * 8/1990 Akira ..... B65H 23/34 162/197
6,003,988 A * 12/1999 McCann ..... B41J 15/04 226/189
6,309,046 B1 10/2001 Izawa et al. ..... 347/40
6,739,688 B2 * 5/2004 Kniazzeh ..... B41J 11/42 347/19
7,036,923 B2 * 5/2006 Takagi ..... B41J 15/048 226/170
7,108,351 B2 * 9/2006 Izawa ..... B41J 15/165 347/104
8,052,272 B2 * 11/2011 Smith ..... B41J 3/543 347/101

(Continued)

FOREIGN PATENT DOCUMENTS

JP 06-070112 3/1994
JP 4518584 8/2010

*Primary Examiner* — Matthew Luu
*Assistant Examiner* — Lily Kemathe
(74) *Attorney, Agent, or Firm* — Ostrolenk Faber LLP

(57) ABSTRACT

Provided is an inkjet printing apparatus including a first transport roller disposed on a transport path transporting a long print medium, a second transport roller disposed on the transport path downstream of the first transport roller, a print medium holder disposed downstream of the second transport roller, and a recording unit discharging ink droplets to a printing area of the print medium, and performing recording operation, the print medium being transported on the transport path. The first transport roller has a first winding angle upon contact to the print medium. The second transport roller has a second winding angle upon contact to the print medium. The first winding angle is larger than the second winding angle. The first winding angle is equal to or more than 75 degrees. The sum of the first and second winding angles is equal to or more than 80 degrees.

14 Claims, 7 Drawing Sheets

(56) References Cited

U.S. PATENT DOCUMENTS

| | | | | |
|---|---|---|---|---|
| 2005/0018029 | A1* | 1/2005 | Takagi | B41J 15/048 347/104 |
| 2005/0103262 | A1* | 5/2005 | Bush | B28B 19/0092 118/258 |
| 2007/0079713 | A1* | 4/2007 | Koeda | B65H 18/10 101/228 |

* cited by examiner

<EMBODIMENT>

PAPER FLOTATION AMOUNT

<EMBODIMENT>

UNEVENNESS OF PAPER FLOTATION AMOUNT (3σ)

<CONVENTIONAL EXAMPLE>

PAPER FLOTATION AMOUNT

<CONVENTIONAL EXAMPLE>

UNEVENNESS OF PAPER FLOTATION AMOUNT (3σ)

INKJET PRINTING APPARATUS

TECHNICAL FIELD

The present invention relates to an inkjet printing apparatus performing printing of characters or images onto a print medium by discharging ink droplets while moving the print medium and printing heads relatively.

BACKGROUND ART

With such an apparatus currently used, a print format has been switched from transaction printing to POD (Print on Demand) printing. The transaction printing performs typical printing onto continuous-form paper. The POD printing often performs various types of printing depending on a print medium such as exclusive paper for inkjet or coated paper. The POD printing requires printing with higher accuracy.

Examples of the apparatus performing high-accurate printing include the following. For instance, a first apparatus (see, for example, Japanese Patent No. 4518584A) and a second apparatus (see, for example, Japanese Unexamined Patent Publication No. H06-70112A) have been suggested. Specifically, the first apparatus has devised arrangement of rollers on a transport path so as to obtain an accurately maintained gap between a printing unit and a printing surface of a printing sheet. The second apparatus has devised an encoder so as to be disposed closed to a printing unit for accurate detection of a transportation speed of a printing sheet.

However, the examples of the currently-used apparatus with the above configurations have the following drawback.

Specifically, the currently-used first apparatus achieves the accurately maintained gap between the printing unit and the printing surface of the printing sheet. This allows enhanced printing accuracy. Moreover, the currently-used second apparatus achieves the accurate detection of the transportation speed of the printing sheet. This also allows enhanced printing accuracy in the transportation direction. However, such the apparatus may produce a drawback that paper flotation or unevenness by wind may cause reduction in printing accuracy. The paper flotation occurs by floating-up of the printing sheet from the transport path by a variation in transportation direction. The unevenness by wind occurs as under. That is, the transportation of the printing sheet causes air flow into the gap between the printing unit and the printing surface of the printing sheet. This leads to the unevenness by wind of disturbing discharge of ink droplets.

SUMMARY OF INVENTION

The present invention has been made regarding the state of the art noted above, and its one object is to provide an inkjet printing apparatus that allows enhanced printing accuracy with devised delivery of a print medium.

Reference is now made to FIG. 3. FIG. 3 illustrates a relationship between a paper flotation amount and unevenness by wind relative to an incidence angle of a printing sheet to a printing unit. Inventors have focused attention on the following feature. That is, a variation in approach angle of the printing sheet to the printing unit causes a variation in floating amount of the printing sheet from a transport path and a variation in amount of air is variable caught in the gap to the printing surface of the printing sheet. Specifically, a paper flotation amount decreases but unevenness by wind increases that is caused by air caught upon delivery of the printing sheet as the approach angle to the printing unit is close to 0 degree. In addition, the unevenness by wind decreases at a given approach angle to the printing unit. On the other hand, the printing sheet delivered at the given approach angle is not controllable to cause an increased paper flotation amount. The present invention has been made based on the above finding, and is constituted as under.

One embodiment of the present invention discloses an inkjet printing apparatus. The apparatus includes a first transport roller disposed on a transport path transporting a long print medium; a second transport roller disposed on the transport path downstream of the first transport roller; a print medium holder disposed downstream of the second transport roller; and a recording unit discharging ink droplets to a printing area of the print medium between the second transport roller and the print medium holder, and performing recording operation, the print medium being transported on the transport path. The first transport roller has a first winding angle upon contact to the print medium. The second transport roller has a second winding angle upon contact to the print medium. The first winding angle is larger than the second winding angle, the first winding angle is equal to or more than 75 degrees, and the sum of the first winding angle and the second winding angle is equal to or more than 80 degrees.

With the embodiment of the present invention, the first winding angle of the first transport roller is set equal to or more than 75 degrees, and is set larger than the second winding angle of the second transport roller, and the second winding angle of the second transport roller is set small. This allows reduction in approach angle of the print medium relative to a line connecting the second transport roller at which the printing area is located and the print medium holder by more than 0 degree with suppression of slide of the print medium on the first transport roller. Consequently, reduction in both paper flotation amount and unevenness by wind is obtainable, allowing prevention of reduction in printing accuracy caused by the paper flotation amount and the unevenness by wind, and thus allowing enhanced printing accuracy.

Moreover, with the embodiment of the present invention, it is preferable that the first winding angle is equal to or more than 75 degrees and is equal to or less than 130 degrees, and the second winding angle is equal to or more than 5 degrees and is equal to or less than 15 degrees.

The first winding angle and the second winding angle are each set to fall within the ranges above. This allows reduction in both paper flotation amount and unevenness by wind while prevention of slide of the print medium on the first transport roller.

Moreover, with the embodiment of the present invention, it is preferable that the first transport roller has a rotation center spaced away from a rotation center of the second transport roller by twice a diameter of the second transport roller.

The first transport roller can be disposed close to the printing unit. Consequently, a shorter distance is obtainable between the first transport roller and the printing unit. This allows reduction in amount of air caught into the printing unit in association with transportation of the print medium. This allows further suppression of the unevenness by wind.

Moreover, with the embodiment of the present invention, it is preferable that the first transport roller has an encoder attached thereto, and outputs a signal depending on a transportation speed of the print medium.

The encoder can be disposed close to the printing unit. This allows a small error of the transportation speed of the print medium. Consequently, more accurate control of the transportation speed is obtainable, allowing enhanced printing accuracy.

BRIEF DESCRIPTION OF DRAWINGS

For the purpose of illustrating the invention, there are shown in the drawings several forms which are presently preferred, it being understood, however, that the invention is not limited to the precise arrangement and instrumentalities shown.

DESCRIPTION OF EMBODIMENTS

The following describes in detail preferred embodiments of the present invention with reference to drawings.

Figure 1:
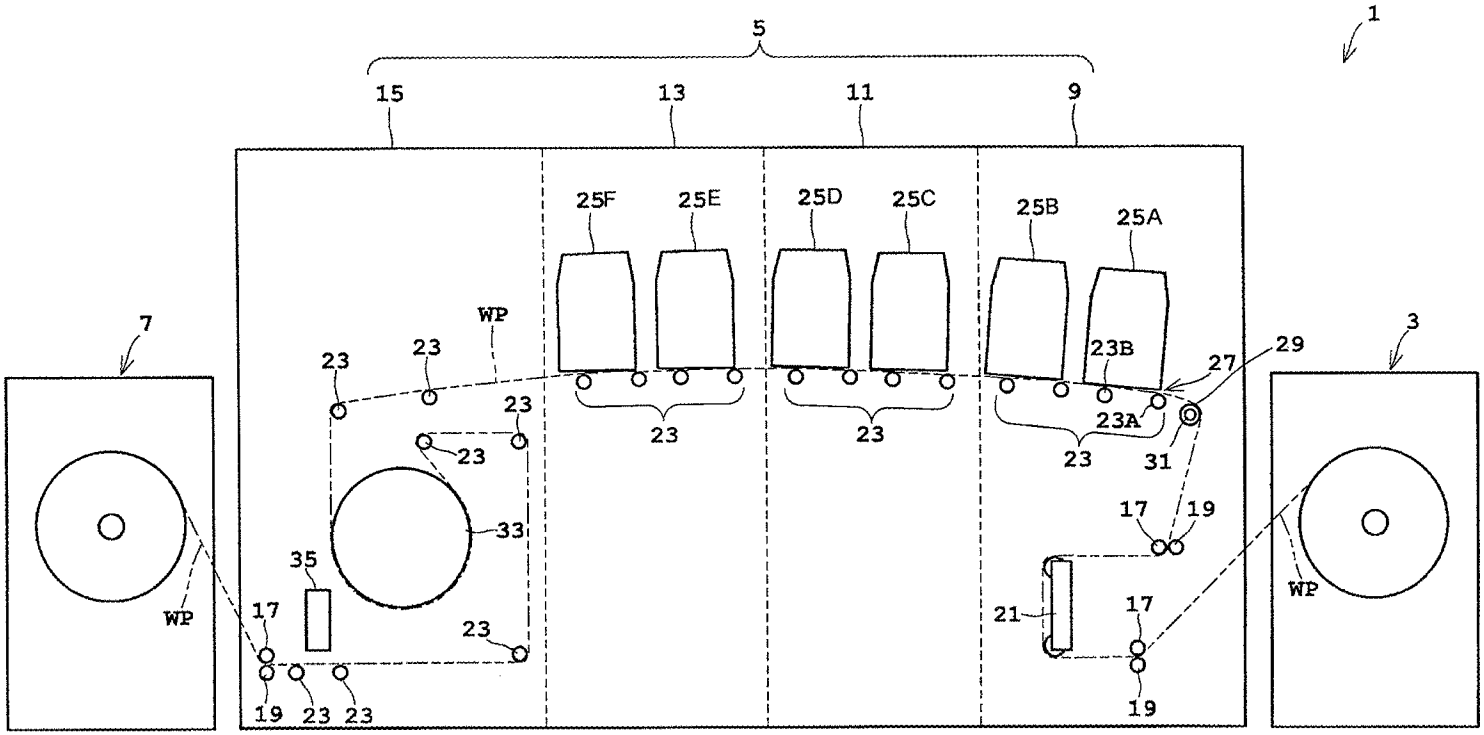
FIG. 1 is a schematic side view of an inkjet printing system according to one embodiment of the present invention.

FIG. 1 is a schematic side view of an inkjet printing system according to one embodiment of the present invention.

The inkjet printing system 1 according to one embodiment of the present invention includes a paper feeder 3, an inkjet printing apparatus 5, and a take-up roller 7.

The paper feeder 3 holds long web paper WP in a roll form to be rotatable about a horizontal axis. The paper feeder 3 unwinds and feeds the web paper WP to the inkjet printing apparatus 5.

The paper feeder 3 holds the web paper WP to be rotatable about the horizontal axis. The paper feeder 3 unwinds and feeds the web paper WP to the inkjet printing apparatus 5. The inkjet printing apparatus 5 performs printing onto the web paper WP received from the paper feeder 3. The take-up roller 7 winds up the web paper WP printed by the inkjet printing apparatus 5 about the horizontal axis. Regarding the side from which the web paper WP is fed as upstream and the side to which the web paper WP is fed out as downstream, the paper feeder 3 is disposed upstream of the inkjet printing apparatus 5, whereas the take-up roller 7 is disposed downstream of the inkjet printing apparatus 5.

Here, the web paper WP corresponds to the "print medium" in the present invention.

The inkjet printing apparatus 5 includes an inlet unit 9, a first intermediate unit 11, a second intermediate unit 13, and an outlet unit 15, in this order, from a side adjacent to the paper feeder 3. The inkjet printing apparatus 5 is formed by the above units 9, 11, 13, and 15 selectively connected as appropriate.

The inlet unit 9 includes a drive roller 17, a nip roller 19, an edge position controller 21, four transport rollers 23A-23D, and two recording units 25A,25B, in this order, from the side adjacent to the paper feeder 3. The drive rollers 17 and the nip rollers 19 take up the web paper WP from the paper feeder 3, and feed the web paper WP to the recording units 25A, 25B. The edge position controller 21 corrects a position of the web paper WP automatically when the web paper WP serpentines in a width direction, whereby the web paper WP is transported correctly. The four transport rollers 23A-23D form a transport path 27, and contact a lower surface of the web paper WP for smoothly transporting the web paper WP along the transport path 27. The recording units 25A,25B each discharge ink droplets to the web paper WP to form a printing image. Here, the two recording units 25A,25B discharge ink droplets in black (K) and cyan (C) respectively.

A first transport roller 29 is disposed between the drive roller 17 and the nip roller 19 downstream of the edge position controller 21 in the inlet unit 9 and a most upstream transport roller 23A of the four transport rollers 23. The first transport roller 29 is referred to as an encoder roller. An encoder 31 is attached to a rotary shaft of the encoder roller. The first transport roller 29 rotates with transportation of the web paper WP. Correspondingly, a signal is outputted from the encoder 31 depending on a transportation speed of the web paper WP. A controller (not shown) controls the transportation of the web paper WP. The controller allows more accurate control of the transportation speed in accordance with the signal from the encoder 31. Here, a transport roller 23 downstream of the first transport roller 29 is referred to as a second transport roller 23A, and a transport roller 23 downstream of the second transport roller 23A is referred to as a third transport roller 23B.

The third transport roller 23B corresponds to the "print medium holder" in the present invention.

The first intermediate unit 11 includes four transport rollers 23 and two recording units 25C,25D. The recording units 25C,25D discharge ink droplets in magenta (M) and yellow (Y) respectively.

The second intermediate unit 13 has the same construction as the first intermediate unit 11 mentioned above. That is, the second intermediate unit 13 includes four transport rollers 23 and two recording units 25. Upstream one of the two recording units 25 discharges ink droplets in gold, and the other downstream one discharges an overcoating agent.

The outlet unit 15 includes a transport roller 23, a heat drum 33, a transport roller 23, an inspecting unit 35, a drive roller 17, and a nip roller 19, in this order, from the upstream of the transport path. The heat drum 33 contains a heater embedded therein. The heat drum 33 rotates in association with the transportation of the web paper WP. The heat drum 33 dries the ink droplets discharged on the web paper WP through heating. The inspecting unit 35 inspects the printed image on the surface of the web paper WP for any printing defect, such as stains or omissions.

Figure 2:
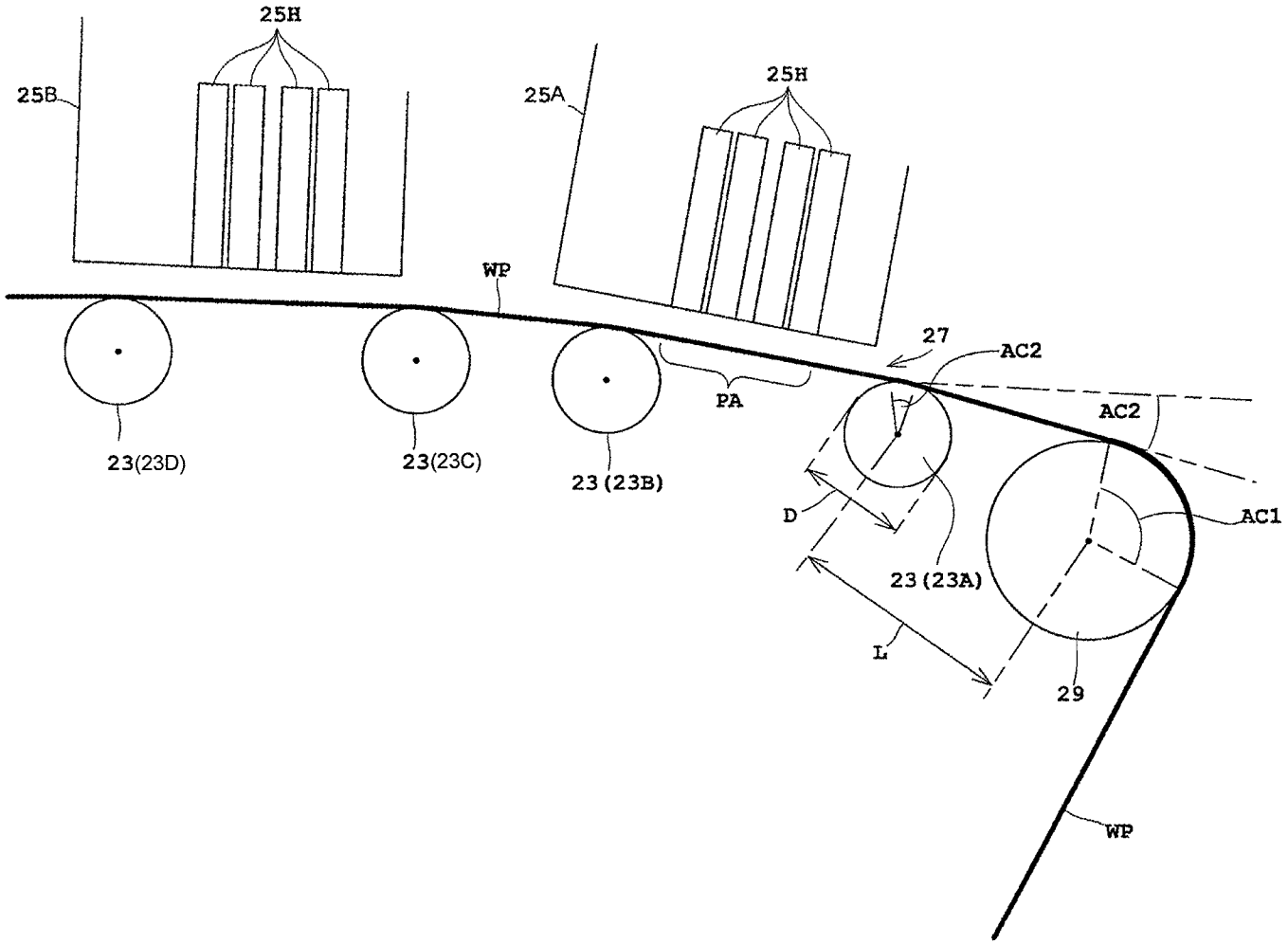
FIG. 2 is a partially-enlarged side view of a printing unit and a transport path according to the embodiment.

Now reference is made to FIG. 2. FIG. 2 is a partially-enlarged side view of the printing unit and the transport path. The following describes the inlet unit 9 of the units 9, 11, 13, and 15.

The recording units 25 each include a plurality of inkjet heads 25H arranged in the width direction of the web paper WP and the transportation direction of the web paper WP. The inkjet heads 25H each include a plurality of inkjet nozzles. The inkjet heads 25H of the recording unit 25 are disposed between the second transport roller 23A and the third transport roller 23B mentioned above. Here, an area of the transport path 27 above which the inkjet heads 25H are located is referred to as a printing area PA. The recording unit 25 records images on the printing area PA of the web paper WP.

The second transport roller 23A is disposed on an extension line connecting the rotation centers of the transport roller 23 and the third transport roller 23B. The first transport roller 29 has the rotation center below the rotation center of the second transport roller 23A (in a direction where the web paper WP is delivered). In addition, the first transport roller 29 has the rotation center away from the rotation center of the second transport roller 23B twice a diameter D of the second transport roller 23B.

Here, a winding angle of the first transport roller 29 is denoted by a first winding angle AC1, and a winding angle of the second transport roller 23A is denoted by a second winding angle AC2. Setting the angles so as to satisfy the following condition allows reduction in paper flotation amount and unevenness by wind.

That is, the first winding angle AC1 is set larger than the second winding angle AC2, and is equal to or larger than 75 degrees. In addition, the sum of the first winding angle AC1 and the second winding angle AC2 is set equal to or more than 80 degrees. The second winding angle AC2 of the second transport roller 23A is equal to a line connecting an upper edge of the second transport roller 23A and an upper edge of the third transport roller 23B when the web paper WP is delivered to a recording unit 25. That is, the second winding angle AC2 is equal to an angle downward from the transport path 27. This is referred to as an approach angle to the recording unit 25. In addition, the first winding angle AC1 of the first transport roller 29 is an angle at which the web paper WP delivered from the drive roller 17 and the nip roller 19 is bent and delivered to the recording unit 25.

Figure 2A:
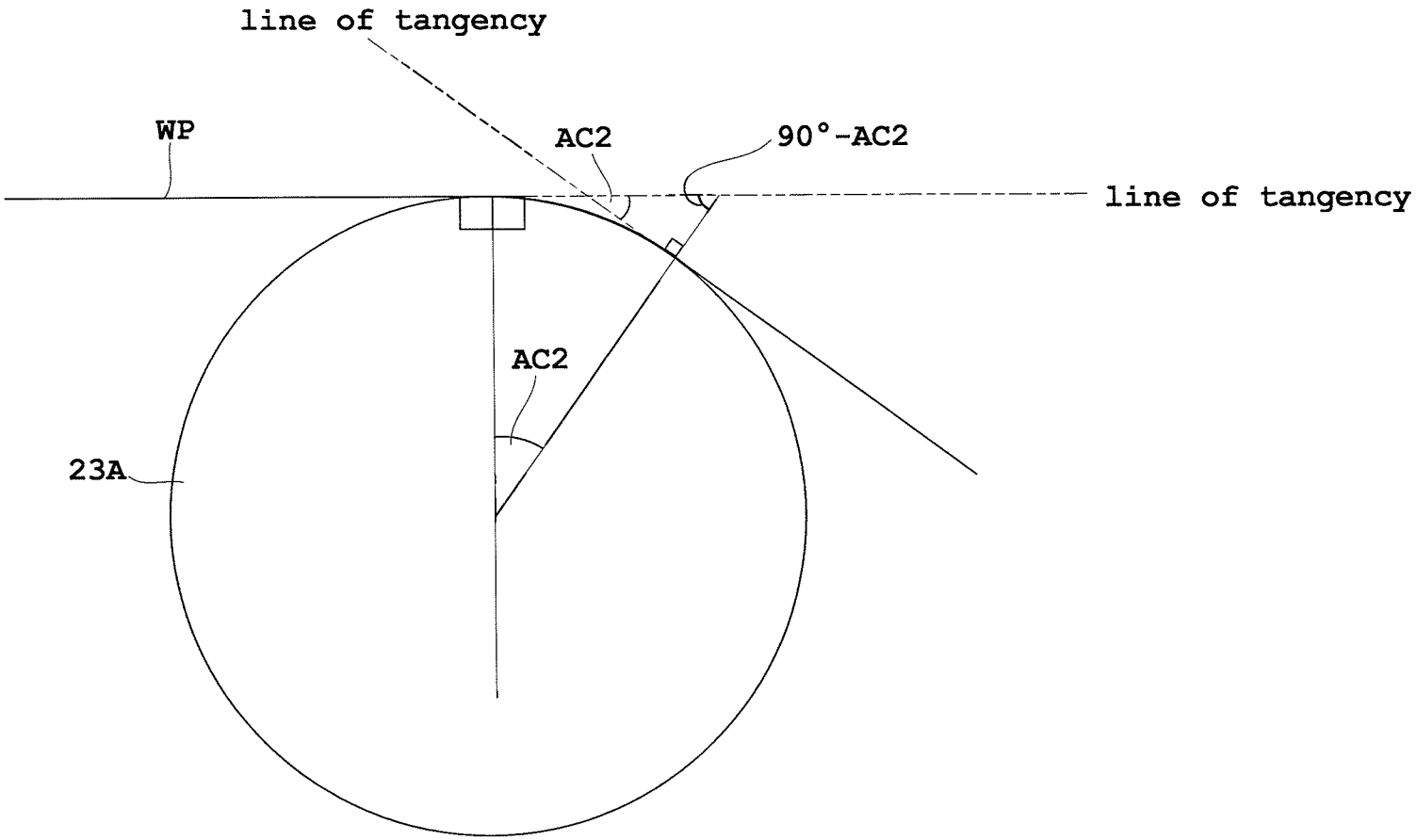
FIG. 2A is an enlarged side view of the second transport roller 23A shown in FIG. 2.
Figure 3:
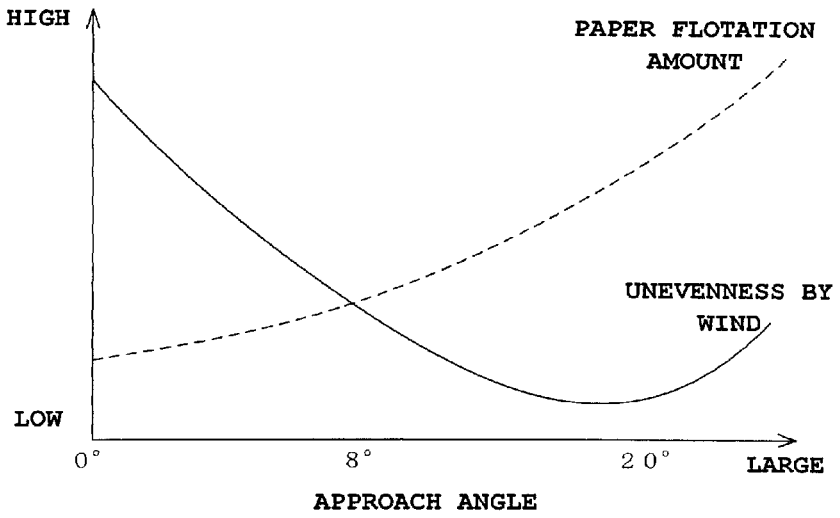
FIG. 3 is a graph illustrating a relationship between a paper flotation amount and unevenness by wind relative to an approach angle of web paper to the printing unit.
Figure 4:
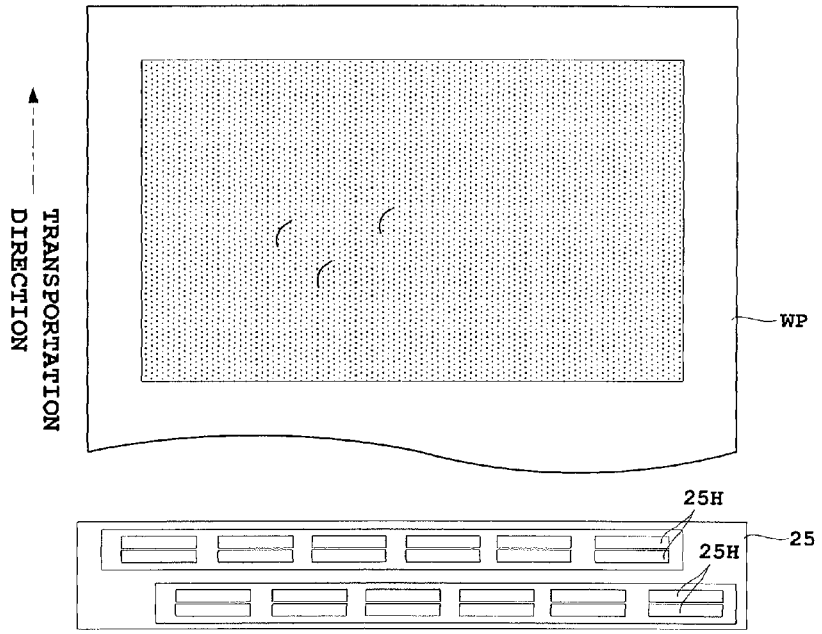
FIG. 4 is a schematic view of an influence of the unevenness by wind.
Figure 5:
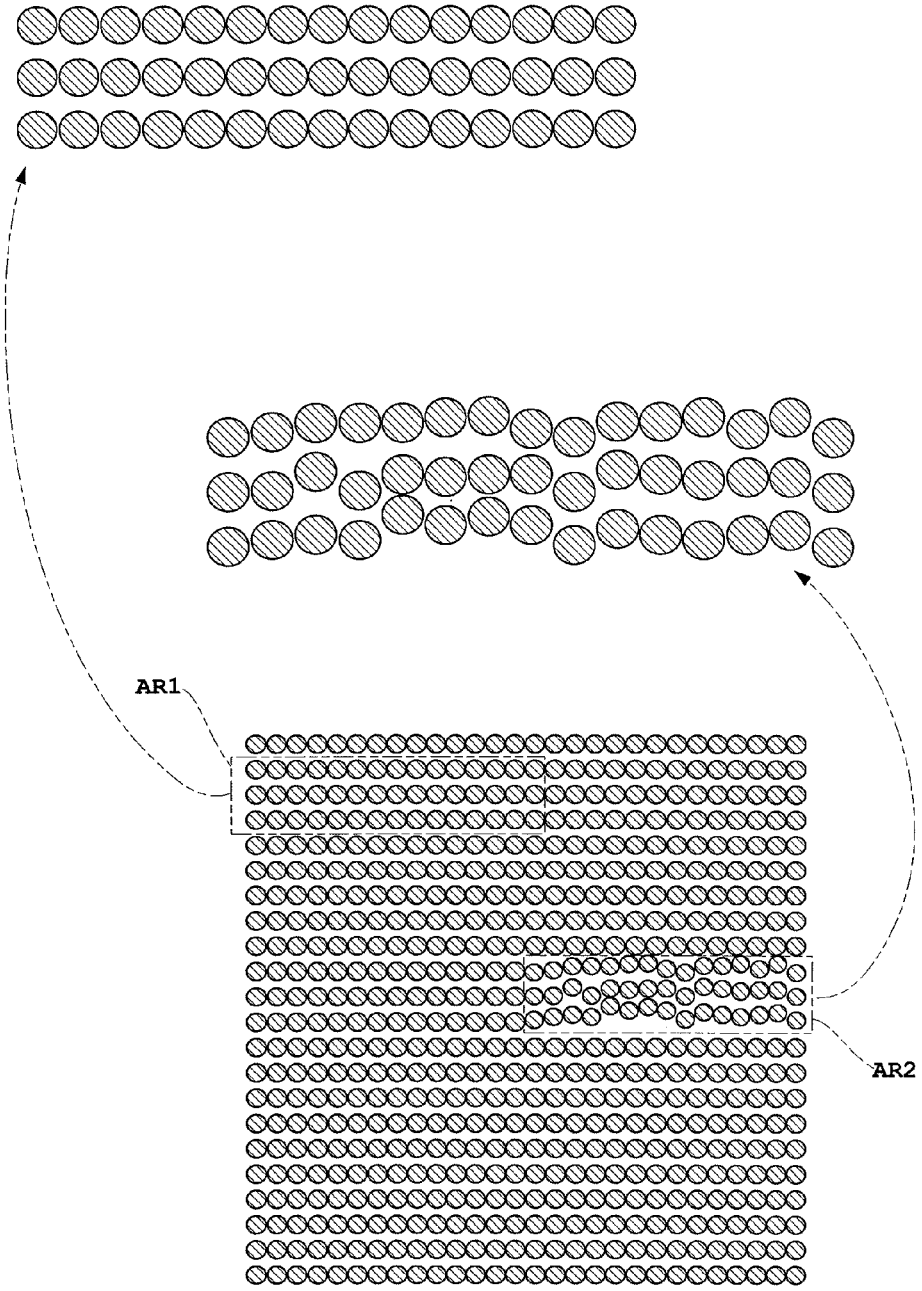
FIG. 5 is an enlarged schematic view of the influence of the unevenness by wind.

FIG. 2A shows the second transport roller 23A and the angle AC2 in more detail. As seen in FIG. 2A, the second winding angle AC2 is the winding angle of the web paper WP around the surface of the roller 23A. AC2 is also the angle defined by lines of tangency at the respective points on the surface of the roller 23A where the web paper WP contacts and leaves the surface of the roller Reference is next made to FIGS. 3 to 5. FIG. 3 is a graph illustrating a relationship between the paper flotation amount and the unevenness by wind relative to the approach angle of the web paper to the printing unit. FIG. 4 is a schematic view of an influence of the unevenness by wind. FIG. 5 is an enlarged schematic view of the influence of the unevenness by wind.

As illustrated in FIG. 3, a paper flotation amount increases as the approach angle (second winding angle AC2) becomes large. The following is estimated to cause the above. That is, when the approach angle reaches a given value, the web paper WP fed from below is bent rapidly, leading to floating of the web paper WP from the transport path 27. Here, the paper flotation amount is a shift in level from a position where the web paper WP is ideally transported on the transport path 27 with no floating-up. The paper flotation amount influences a gap between the recording unit 25 and the web paper W. Accordingly, the paper flotation amount also influences a printing quality.

On the other hand, the unevenness by wind increases gradually when the approach angle (second winding angle AC2) has a given value. The following is estimated to cause the above. That is, when the approach angle is small, air on the surface of the web paper WP readily enters the printing area PA together with the web paper WP. In contrast to this, when the approach angle reaches a given value, air is removed from the surface of the web paper WP and thus the air is unlikely to enter the printing area PA together with the web paper WP. The unevenness by wind corresponds to flow of ink droplets caused by air entering the printing area PA. Here, the unevenness by wind is influenced by flow of air around the apparatus. Consequently, the unevenness by wind is unstable and almost always varies. For instance, the unevenness by wind significantly decreases the printing quality since the unevenness by wind is observed in the image already printed as illustrated in FIG. 4 due to flow of the ink droplets.

Moreover, as illustrated in FIG. 5, the influence of the unevenness by wind is recognized significantly when dots are printed at given intervals through the nozzles of the inkjet heads 25H in the recording unit 25. That is, dots are aligned in line in an area AR1 under no influence of the unevenness by wind. In contrast to this, dots are flown in unintended directions in an area AR2 under the influence of the unevenness by wind. This causes dots with various intervals. As a result, it is revealed from the lower side of the drawing that a density becomes non-uniform and the printing quality is decreased although the dots are printed at given intervals.

It is preferable to set the first winding angle AC1 and the second winding angle AC2 so as to satisfy the following condition.

The first winding angle AC1 is set to be equal to or more than 75 degrees and equal to or less than 130 degrees, and the second winding angle AC2 is set to be equal to or more than 5 degrees and equal to or less than 15 degrees. Setting the angles to fall within the above ranges allows reduction in both paper flotation and unevenness by wind while preventing slide of the print medium on the first transport roller. Moreover, it is preferable that the first winding angle AC1 is 98 degrees and the second winding angle AC2 is 7 degrees.

With the present embodiment, the first winding angle AC1 of the first transport roller 29 is set equal to or more than 75 degrees, and is set larger than the second winding angle AC2 of the second transport roller 23A, and the second winding angle AC2 of the second transport roller 23A is set small. This allows reduction in approach angle of the web paper WP to a line connecting the second transport roller 23A and the third transport roller 23B at which the printing area PA is located to be more than 0 degree with suppression of slide of the web paper WP on the first transport roller 29. Consequently, reduction in both paper flotation amount and unevenness by wind is obtainable, allowing prevention of reduction in printing accuracy caused by the paper flotation amount and the unevenness by wind, and thus allowing enhanced printing accuracy.

Moreover, the first transport roller 29 is disposed close to the second transport roller 23A by a distance L. Accordingly, the first transport roller 29 can be disposed close to the printing unit 25. Consequently, a shorter distance is obtainable between the first transport roller 29 and the printing unit 25. This allows reduction in amount of air caught into the printing unit 25 in association with transportation of the web paper. This allows further suppression of the unevenness by wind.

Moreover, the encoder 31 can be disposed close to the printing unit 25. This allows a small error of the transportation speed of the web paper WP. Consequently, more accurate control of the transportation speed is obtainable, allowing enhanced printing accuracy.

Figure 6:
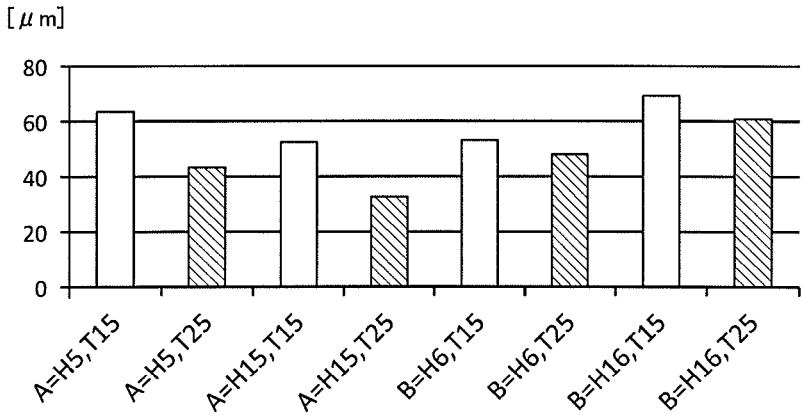
FIG. 6 is a graph illustrating a relationship between the paper flotation amount and tension according to the embodiment.
Figure 7:
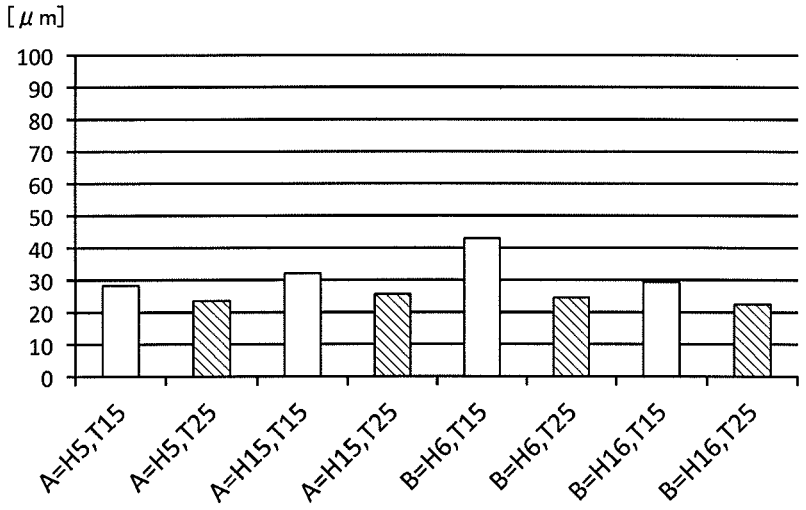
FIG. 7 is a graph illustrating unevenness of the paper flotation amount according to the embodiment.
Figure 8:
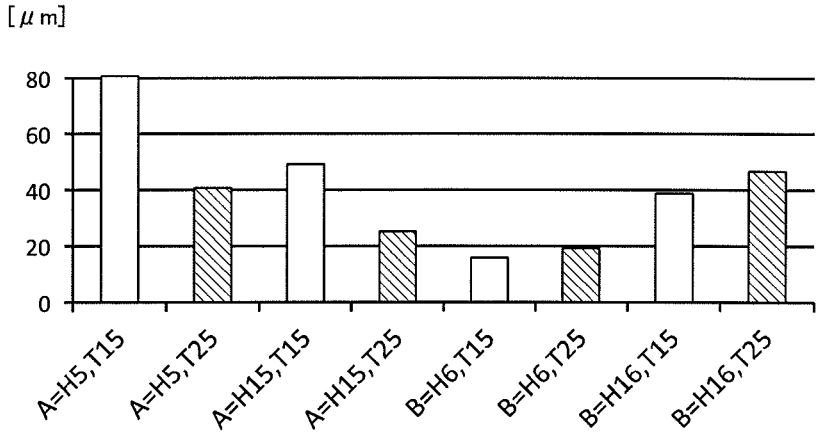
FIG. 8 is a graph illustrating a relationship between a paper flotation amount and tension according to the conventional example.
Figure 9:
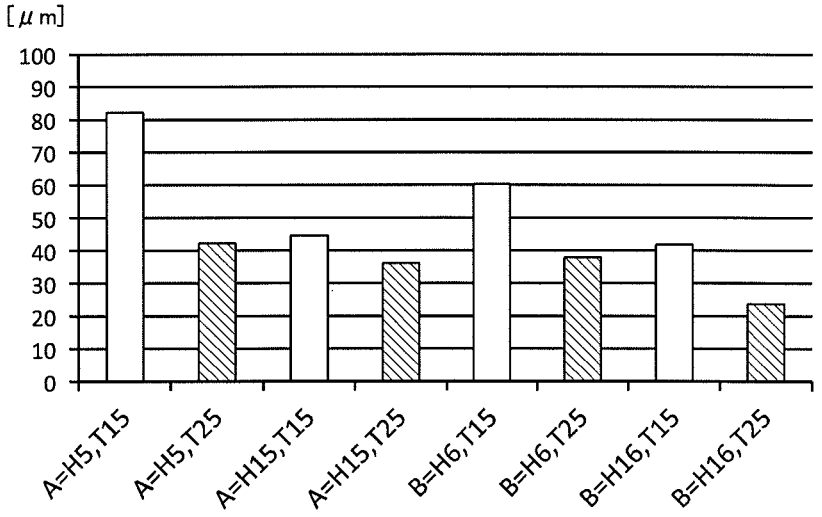
FIG. 9 is a graph illustrating unevenness of a paper flotation amount according to the conventional example.

Now comparison is made for a paper flotation amount between the above embodiment and the conventional example with reference to FIGS. 6 to 9. FIG. 6 is a graph illustrating a relationship between a paper flotation amount and tension in the present embodiment. FIG. 7 is a graph illustrating unevenness in paper flotation amount in the present embodiment. FIG. 8 is a graph illustrating a relationship between a paper flotation amount and tension in the conventional example. FIG. 9 is a graph illustrating unevenness in paper flotation in the conventional example. FIGS. 6 to 9 each include portions with no hatching in which tension of the web paper WP has a normal value of 15 kg, and portions with hatching in which tension of the web paper has a value of 25 kg higher than the normal value. Moreover, FIGS. 6 to 9 illustrates on the left thereof the results for the upstream heads and on the right thereof the results for the downstream heads.

Here in the present embodiment, the first winding angle AC1 is set 98 degrees, and the second winding angle AC2 is set 7 degrees. Moreover, in the conventional example, the first and second winding angles are set so as not to satisfy the above condition.

Setting tension at high values allows suppression of uncontrolled movement of the web paper WP. Accordingly, at tension having high values (portions with hatching), the paper flotation amounts in the present embodiment and the conventional examples are both almost lower than those at tension having normal values (portions without hatching). Moreover, it is revealed from FIG. 8 that the paper flotation amount is increased in the upstream heads since the upstream heads are largely influenced by the uncontrolled movement of the web paper WP. In contrast to this, in the present embodiment, it is revealed that there is no significant difference on influence of the uncontrolled movement of the web paper WP between the upstream heads and the downstream heads. Such measuring of the paper flotation amount is performed for plurality of times to obtain results of unevenness illustrated in FIGS. 7 and 9. It is revealed from FIGS. 7 and 9 through comparison that unevenness is much smaller and is more stable in the present embodiment than in the conventional example, and thus the present embodiment can produce an effect generated by satisfying the above condition.

The present invention is not limited to the foregoing examples, but may be modified as follows.

(1) In the embodiment mentioned above, the web paper WP has been described as one example of a print medium. However, the present invention is not only applicable to the web paper WP. The present invention is applicable to other type of print medium with a long length. For instance, examples of the print medium include a film.

(2) In the embodiment mentioned above, a plurality of recording units 25 are provided, and the units 9, 11, 13, and 15 may be combined flexibly. However, such a configuration is not essential to the present invention.

(3) The embodiment mentioned above includes the encoder 31 in the first transport roller 29. However, the present invention is not limited to such a configuration. Alternatively, the encoder 31 may be provided in other portions.

The present invention may be embodied in other specific forms without departing from the spirit or essential attributes thereof and, accordingly, reference should be made to the appended claims, rather than to the foregoing specification, as indicating the scope of the invention.

What is claimed is:

1. An inkjet printing apparatus, comprising:

a first transport roller disposed on a transport path transporting a long print medium in a downstream direction;

a second transport roller disposed on the transport path downstream of the first transport roller;

a print medium holder disposed downstream of the second transport roller; and a plurality of recording units discharging ink droplets to the print medium, and performing a recording operation, the print medium being transported on the transport path, the first transport roller having a first winding angle upon contact to the print medium, the second transport roller having a second winding angle upon contact to the print medium, the first winding angle being larger than the second winding angle, the first winding angle being equal to or more than 75 degrees, and the sum of the first winding angle and the second winding angle being equal to or more than 80 degrees, the plurality of recording units includes a most-upstream recording unit that includes an ink jet head discharging the ink droplets to a printing area of the print medium between the second transport roller and the print medium holder, and performing a recording operation, the second winding angle being defined with respect to a line connecting an upper edge of the second transport roller and an upper edge of the print medium holder when the print medium is delivered to the most-upstream recording unit, and being an acute angle defined between the path of the print medium upstream from the second transport roller, and the path of the print medium downstream from the second transport roller, the second transport roller is arranged under an upstream end of the most-upstream recording unit, the print medium holder is arranged under the most-upstream recording unit and on a downstream side from the ink jet head of the most-upstream recording unit, and the printing area is defined between the second transport roller and the print medium holder, wherein the first winding angle is equal to or more than 75 degrees and is equal to or less than 130 degrees, and the second winding angle is equal to or more than 5 degrees and is equal to or less than 15 degrees.

2. The inkjet printing apparatus according to claim 1, wherein the first transport roller has a rotation center spaced away from a rotation center of the second transport roller by twice a diameter of the second transport roller.

3. The inkjet printing apparatus according to claim 1, wherein the first transport roller has an encoder attached thereto, and outputs a signal depending on a transportation speed of the print medium.

4. The inkjet printing apparatus according to claim 2, wherein the first transport roller has an encoder attached thereto, and outputs a signal depending on a transportation speed of the print medium.

5. The inkjet printing apparatus according to claim 1, wherein the first transport roller has the rotation center below the rotation center of the second transport roller.

6. The inkjet printing apparatus according to claim 2, wherein the first transport roller has the rotation center below the rotation center of the second transport roller.

7. The inkjet printing apparatus according to claim 3, wherein the first transport roller has the rotation center below the rotation center of the second transport roller.

8. The inkjet printing apparatus according to claim 4, wherein the first transport roller has the rotation center below the rotation center of the second transport roller.

9. The inkjet printing apparatus according to claim 1, wherein the print medium holder is a third transport roller.

10. The inkjet printing apparatus according to claim 2, wherein the print medium holder is a third transport roller.

11. The inkjet printing apparatus according to claim 1, wherein the print medium is wound in the same direction with respect to the first transport roller and the second transport roller.

12. The inkjet printing apparatus according to claim 1, wherein the first transport roller, the second transport roller, and the print medium holder are disposed at the lower side of the print medium and are disposed in this order with respect to the recording unit.

13. The inkjet printing apparatus according to claim 1, wherein the recording unit is disposed at the upper side of the print medium and between the second transport roller and the print medium holder.

14. The inkjet printing apparatus according to claim 1, wherein the upper side of the print medium between the second transport roller and the recording unit is free of any components that contact the print medium.

* * * * *